United States Patent [19]

Yamamura et al.

[11] 4,252,540

[45] Feb. 24, 1981

[54] STABILIZER FOR MIXTURE FUELS

[75] Inventors: Masaaki Yamamura; Noboru Moriyama; Masayuki Abe, all of Wakayama, Japan

[73] Assignee: Kao Soap Co., Ltd., Tokyo, Japan

[21] Appl. No.: 82,516

[22] Filed: Oct. 9, 1979

[30] Foreign Application Priority Data

Oct. 12, 1978 [JP] Japan ..... 53/125625

[51] Int. Cl.[3] ..... C10L 1/32; C10L 1/18

[52] U.S. Cl. ..... 44/51; 44/77; 252/351; 252/DIG. 1

[58] Field of Search ..... 44/51, 77; 252/351, 252/DIG. 1

[56] References Cited

U.S. PATENT DOCUMENTS

| | | | |
|---|---|---|---|
| 2,430,085 | 11/1947 | Spencer et al. | 44/51 |
| 2,674,619 | 4/1954 | Lundsted | 252/353 |
| 2,677,700 | 5/1954 | Jackson et al. | 252/353 |
| 4,030,894 | 6/1977 | Marlin et al. | 44/51 |
| 4,094,810 | 6/1978 | Thomas | 44/51 |
| 4,147,519 | 4/1979 | Sawyer | 44/51 |

*Primary Examiner*—Winston A. Douglas
*Assistant Examiner*—J. V. Howard
*Attorney, Agent, or Firm*—Blanchard, Flynn, Thiel, Boutell & Tanis

[57] ABSTRACT

A stabilizer for mixture fuels of finely divided coal and fuel oil comprises as an active ingredient a non-ionic surface active agent consisting of a block copolymer represented by the following general formula (I):

$$R^1O-(C_2H_4O)_l-(C_3H_6O)_m-(C_2H_4O)_n-R^2 \quad (I)$$

wherein $R^1$ and $R^2$ stand for a hydrogen atom or an alkly group having 1 to 6 carbon atoms, the mole number (l+n) of added ethylene oxide is in the range of from 30 to 300, the mole number (m) of added propylene oxide is in the range of from 15 to 80, and the content of ethylene oxide in the whole molecule is 40 to 85% by weight.

7 Claims, 1 Drawing Figure

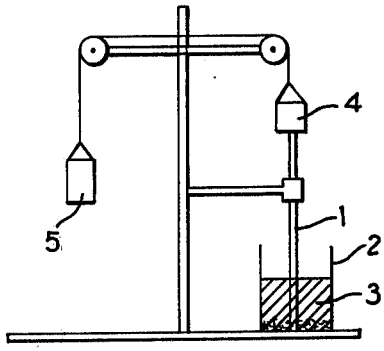
4
1
2
3
5

STABILIZER FOR MIXTURE FUELS

FIELD OF THE INVENTION

The present invention relates to a stabilizer for mixture fuels. More particularly, the invention relates to a stabilizer for mixture fuels, which is used as a dispersant when finely divided coal is dispersed in fuel oil.

DESCRIPTION OF PRIOR ARTS

In the First World War and the Second World War, researches were made on mixture fuels comprising coal and fuel oil, such as heavy oil or crude oil, for military and other purposes. Since these researches were mainly directed to cope with the shortage of petroleum, when the supply of petroleum became stable, these researches were stopped. In the transportation of coal, various troublesome operations such as loading, unloading and shifting must be performed and much manual labor is are required. Accordingly, coal-containing liquid fuels were conceived as a means for reducing the handling cost of coal. In fact, in France and the United States, an aqueous slurry transportation system, that is, a system of hydraulic transportation of finely divided coal through a pipe line, was developed. Also in Japan, this aqueous slurry transportation system was examined. In Japan, marine transportation prevails, and if excess water is shipped, the transportation cost is increased. Moreover, a high efficiency cannot be attained on combustion of an aqueous slurry of coal. Accordingly, this system was not put into actual use in Japan. On the assumption that if a petroleum type fuel is used instead of water, the defects of this aqueous slurry of coal will be overcome, a mixture fuel of coal and fuel oil, such as heavy oil or crude oil, that is, a so-called coal-oil mixture (COM), now attracts attention in the art. The price of petroleum has increased in recent years and it is considered that a reduction of the cost will be easier to achieve for COM than for heavy oil. Accordingly, researches have been vigorously made to enable practical utilization of COM. In Japan, coal must be imported from abroad and reduction of the handling cost will result directly in a reduction of the price, and therefore, great expectations are harbored for the practical utilization of COM.

COM has the following advantages.

(1) COM is higher in the calorific value than coal, and present petroleum combustion equipment can be used only after a small modification.

(2) Marine transportation by tankers is possible, and large quantities of coal can be transported at high efficiency.

(3) Long-distance land transportation (pipe line transportation) is possible.

(4) Spontaneous combustion of coal during transportation can be prevented and therefore, it becomes possible to import brown coal which has not been imported in spite of its low price because spontaneous combustion readily occurs in brown coal.

(5) The storage space can be reduced, the specific gravity of COM is larger than that of water, and even if a fire accident takes place, fire extinguishing can be easily accomplishing without occurrence of a blow-out accident which is caused in crude oil.

(6) Stable supply can be expected and COM is preferred from the economical viewpoint.

(7) Large quays and large loading and transporting equipments are necessary for marine transportation of coal, but present quays and equipments for marine transportation of petroleum can be utilized for marine transportation of COM.

Solid coal particles are sedimented in fuel oil, which forms the dispersion medium in COM, according to the difference of the specific gravity. Since the sedimentation speed is low when the particle size of coal is small, it is preferred to divide coal as finely as possible. However, the pulverizing cost increases as the degree of pulverization is elevated. Finely divided coal, which is now used in a power plant, has a size such that about 80% passed through a 200 mesh screen, that is, about 74 microns. Accordingly, it is considered that this particle size may be a standard for the particle size of the finely divided coal in COM. When a surface active agent is incorporated as a stabilizer into COM, the surface active agent is adsorbed on the interface between the coal particles and the fuel oil, and the surface active agent exerts functions of crumbling the coal particles and preventing agglomeration of the coal particles. In the case of COM, the surface active agent is required to exhibit another function of causing the coal particles sedimented in a lower portion to form soft precipitates. When COM is stored for a long time, it is desirable to obtain homogeneous COM again very easily by agitation, and for this purpose, it is required that the coal particles form very soft precipitates which can easily be re-dispersed. Once prepared COM should pass through various processes such as pipe line transportation, tanker transportation and tank storage before it is burnt. Accordingly, it is required that the sedimentation speed of coal particles should be low and the coal particles should be re-dispersed very easily. Ordinarily, in the absence of a stabilizer, coal particles are substantially precipitated if COM is allowed to stand for 1 or 2 days after preparation, although the sedimentation speed differs to some extent according to the combination of coal and oil that is used, the sedimented precipitates are very hard and re-dispersion is very difficult. Accordingly, if it is necessary to store COM for a long time after preparation, the role of the stabilizer is very important and development of an excellent stabilizer is eagerly desired. Since COM passes through the above-mentioned various processes after preparation, the period during which COM is stably stored should be at least 4 to 7 days, preferably at least 15 to 30 days, and stored COM should have good re-dispersibility.

Many patents claiming stabilizers for COM have been issued, and the majority of commercially available surface active agents are disclosed in the specifications of those patents. However, each of them is insufficient in the COM stabilizing effect. Accordingly, development of an excellent stabilizer has eagerly been desired. Since the particle size of coal in COM is relatively large as pointed out hereinbefore, coal particles are sedimented if COM is stored for a long time. As the method for delaying semdimentation of coal particles, the specifications of patents teach a method in which certain additives are added to increase the viscosity or form a thixotropic mixture. Even if this method is adopted, parts of coal particles are sedimented to form hard precipitates. Moreover, limitations are imposed on the formation of thixotropic mixtures. For example, the viscosity is drastically increased and various practical troubles are caused in handling and other operations, and therefore, the commercial value of COM is extremely lowered.

SUMMARY OF THE INVENTION

We made researches with a view to overcoming these defects involved in conventional stabilizers for COM, and as a result, we have now completed the present invention.

More specifically, in accordance with the present invention, there is provided a stabilizer for mixture fuels of finely divided coal and fuel oil, which comprises as an active ingredient a non-ionic surface active agent consisting of a block copolymer represented by the following general formula (I):

$$R^1O-(C_2H_4O)_l-(C_3H_6O)_m-(C_2H_4O)_n-R^2 \quad (I)$$

wherein $R^1$ and $R^2$ stand for a hydrogen atom or an alkyl group having 1 to 6 carbon atoms, the mole number (l+n) of added ethylene oxide is in the range of from 30 to 300, the mole number (m) of added propylene oxide is in the range of from 15 to 80, and the content of ethylene oxide in the whole molecule is 40 to 85% by weight.

The polymer of the present invention, that is represented by the above general formula (I), is obtained by copolymerizing ethylene oxide with propylene oxide, and it has hydroxyl groups or ethers of alkyl groups having 1 to 6 carbon atoms on the terminals thereof. Block copolymerization providing the structure of the general formula (I) is effective, whereas a polymer formed by random copolymerization has no substantial effect. In order to obtain the polymer of the present invention, it is indispensable that 30 to 300 moles of ethylene oxide should be copolymerized with 15 to 80 moles of propylene oxide, but it is preferred that 50 to 200 moles of ethylene oxide and 15 to 50 moles of propylene oxide be used. It is preferred that the content of ethylene oxide units in the polymer be 45 to 80% by weight, especially 70 to 80% by weight. If the amount used of ethylene oxide is smaller than 30 moles, the polymer is too hydrophobic and the stabilizing effect is reduced. If the amount used of ethylene oxide exceeds 300 moles, the molecular weight becomes too high and dissolution of the polymer becomes difficult, causing various practical troubles. If the ethylene oxide content in the whole polymer is at least 40% especially at least 45%, the stabilizing effect is remarkably increased. If the stabilizers of this type are insoluble or hardly soluble in oil, a higher stabilizing effect is obtained. It is considered that as the mole number of added ethylene oxide, the hydrophilic property is increased and the polymer becomes oil-insoluble.

When the stabilizer of the present invention is added to COM in an amount of 0.1 to 1.0% by weight, preferably 0.05 to 0.5% by weight, based on COM, coal particles can be stably dispersed in fuel oil, and coal particles sedimented in the lower portion form soft precipitates which can be re-dispersed very easily. Generally, when solid fine particles are dispersed with the aid of a dispersant, as the stabilizing effect is high, sedimented precipitates accumulated during long-time storage are hard. However, in COM, it is required that soft precipitates that can be re-dispersed very easily should be formed. The stabilizer of the present invention fully meets this requirement and provides precipitates that can be redispersed very easily.

When the mixing ratio of coal (C) to fuel oil (O) in COM, that is, the C/O weight ratio, is too low, the significance of COM is lost. If the C/O weight ratio is too high, the viscosity becomes too high. Accordingly, it is preferred that the C/O weight ratio be in the range of from 20/80 to 70/30, particularly from 40/60 to 55/45, although the preferred C/O weight ratio differs according to the coal-oil combination. In view of the transportation efficiency, it is preferred that the amount of water contained in COM be small. From the viewpoints of stability and re-dispersibility, it is preferred that a certain amount of water be contained in COM. Generally, water is contained in coal in an amount of 1 to 6% by weight. In some case, coal contains water in an amount of about 20 to about 40% by weight. When such a large amount of water is contained in coal, it is preferred that the water content is preliminarily reduced below 15%, especially below 3–5% by heating or the like means and the treated coal be then used for preparation of COM. When water is naturally contained in coal in an amount of 1 to 6% by weight, water may be removed in advance or it may not be removed.

In connection with the mixing order of coal, the stabilizer and fuel oil, there may be adopted a method in which the stabilizer is dissolved in fuel oil, coal is then added and COM is prepared by using an appropriate mixer or pulverizer. However, COM having an improved stability can be obtained by a method in which coal is first incorporated in fuel oil, the mixture is treated by an appropriate mixer or pulverizer to form COM and the stabilizer is added thereto. The kind of the mixer or pulverizer is not particularly critical, provided that a good mixing or pulverizing effect is attained.

The fuel oil referred to in the present invention includes all the liquid fuel oils such as heavy oil and crude oil.

BRIEF DESCRIPTION OF THE DRAWING:

The drawing is a diagram illustrating an apparatus to be used for measuring the hardness of precipitates in COM.

In the drawing, the reference numeral 1 identifies a stainless steel rod, 2 is a graduated cylinder, 3 is the coal-oil mixture (COM) and 4 and 5 are weights.

The present invention will now be described in detail by reference to the following Examples that by no means limit the scope of the invention.

EXAMPLE 1

In a graduated cylinder having an inner diameter of 50 mm, 241.8 g (exclusive of water in oil) of Middle East heavy oil[1]) was charged, and a predetermined amount of a stabilizer was added and the mixture was dipped in an oil bath maintained at 70° C. Then, 250 g (exclusive of water in coal) of Vermont coal[2]) which had been pulverized so that 80% of the particles passed through a 200-mesh sieve, was added to the above Middle East heavy oil. Water was contained in an amount of 0.03% in the Middle East heavy oil and in an amount of 3.25% in the Vermont coal. Accordingly, the weight ratio of coal (on the dry base)/(Middle East heavy oil plus water) was 50/50. The sum of the amounts of water contained in the oil and water contained in the coal was 8.2 g. When the graduated cylinder charged with the stabilizer-incorporated oil and coal was dipped in an oil bath maintained at 70° C. for 1 hour, the temperature of the mixture became constant. Then, the coal-oil mixture in the graduated cylinder was stirred at 3000 rpm for 30 minutes by using a laboratory mixer (manufactured by Tokushu Kikako) to form COM. The COM was stored in an oil bath maintained at 70° C. for a certain time, and the stability of COM was evaluated by using an apparatus shown in FIG. 1. More specifically, it was checked whether or not a stainless steel rod 1 having a diameter of 5 mm (weights 4 and 5 were adjusted so that a load of 20 g was applied) could pierce the formed precipitate and arrive at the bottom of the graduated cylinder 2 charged with COM 3 which had been allowed to stand for 15 days, and the time required for the rod 1 to arrive at the bottom of the cylinder 2 was measured.

(1) Middie East Heavy Oil (produced in the Middle East):

Calorific value: 10310 Kcal/Kg (JIS K-2265)
Specific gravity: 0.9576
Pour point: −2.5° C. (JIS K-2269)
Flash point: 94.0° C. (JIS K-2265)
Ash content: 0.02% (JIS K-2272)
Water content: 0.03% (JIS K-2275)
Elementary analysis value (Yanagimoto organic material autoanalyzer):
C=84.17%, H=13.06%, S=2.39%, N=0.25%, O=0.13%, Cl=3.3 ppm, V=65 ppm, Na=15 ppm (2) Vermont Coal (produced in Australia):

High grade calorific value: 6550 Kcal/Kg (JIS M-8814)
Ash content: 15.95% (JIS M-8812)
Water content: 3.25% (JIS M-8812)
Fixed carbon: 49.35% (JIS M-8812)
Elementary analysis values (JIS M-8813):
C=16.17%, H=4.71%, N=1.23%, O=8.44%, S=0.50%, Cl=0.03%, Na=0.04%

The re-dispersibility of COM which had been allowed to stand for 15 days was evaluated according to the following procedures.

COM which had been allowed to stand for 15 days was stirred at 3000 rpm for 30 minutes by using the laboratory mixer and was then stored for 7 days in an oil bath maintained at 70° C. Evaluation was conducted according to the same method as described above with respect to evaluation of the stability.

Obtained results are shown in Table 1.

TABLE 1

| Sample No. | Stabilizer[3] | EO content (%) | Amount (%) of Stabilizer[1] | Stability (sec)[2] | Re-dispersibility (sec)[2] |
|---|---|---|---|---|---|
| Samples of Present Invention | | | | | |
| 1 | $R^1$ = H, $R^2$ = H (l + n) = 90 m = 17 | 80 | 0.20 | 0.3 | 0.1 |
| 2 | " | 80 | 0.10 | 1.2 | 0.6 |
| 3 | $R^1$ = H, $R^2$ = H (l + n) = 150 m = 30 | 79 | 0.10 | 0.6 | 0.3 |
| 4 | $R^1$ = H, $R^2$ = H (l + n) = 200 m = 40 | 79 | 0.10 | 0.5 | 0.2 |
| 5 | $R^1$ = H, $R^2$ = H (l + n) = 50 m = 40 | 49 | 0.10 | 1.7 | 1.0 |
| 6 | $R^1$ = butyl, $R^2$ = H (l + n) = 50 m = 45 | 46 | 0.20 | 1.4 | 1.0 |
| 7 | " | 46 | 0.10 | 3.4 | 2.0 |
| Comparative Samples | | | | | |
| 1 | not added | | 0.00 | X | X |
| 2 | POE (5) nonylphenyl ether | | 0.20 | X | X |
| 3 | POE (9) nonylphenyl ether | | 0.20 | X | X |
| 4 | sorbitan mono-oleate | | 0.20 | X | X |
| 5 | POE (15) sorbitan mono-oleate | | 0.20 | X | X |
| 6 | sodium oleate | | 0.20 | X | X |
| 7 | $R^1$ = H, $R^2$ = H (l + n) = 30 m = 55 | 29 | 0.10 | 12.3 | 6.2 |
| 8 | $R^1$ = H, $R^2$ = H (l + n) = 22 m = 66 | 20 | 0.10 | X | 5.0 |
| 9 | $R^1$ = H, $R^2$ = H (l + n) = 10 m = 30 | 20 | 0.10 | X | X |
| 10 | $R^1$ = H, $R^2$ = H (l + n) = 50 m = 40[4] | 49 | 0.10 | X | X |

Note
[1]The amount of the stabilizer was expressed in % by weight based on the entire mixture.
[2]The stability and re-dispersibility were evaluated by the time required for a rod having a load of 20 g to pierce COM. A shorter time shows a better property. The mark "X" means that the rod could not pierce COM with a load of 20 g.
[3]$R^1$, $R^2$, l, m and n are those in the general formula (I).
[4]The sample was prepared by random copolymerization.

What is claimed is:

1. A method for stabilizing a mixture of finely divided coal and fuel oil, which comprises the step of blending in said mixture an effective stabilizing amount of nonionic surface active agent consisting of a block copolymer of the formula (I):

$$R^1O-(C_2H_4O)_l-(C_3H_6O)_m-(C_2H_4O)_n-R^2 \quad (I)$$

wherein $R^1$ and $R^2$ are hydrogen or alkyl having 1 to 6 carbon atoms, the mole number (l+n) of added ethylene oxide is in the range of from 30 to 300, the mole number (m) of added propylene oxide is in the range of from 15 to 80, and the content of ethylene oxide in the molecule is 40 to 85% by weight.

2. A method as claimed in claim 1 wherein $R^1$ and $R^2$ are hydrogen.

3. A method as claimed in claim 1 wherein in the formula (I), the content of ethylene oxide in the molecule is 45 to 80% by weight, the mole number (l+n) is in the range of from 50 to 200 and the mole number (m) is in the range of from 15 to 50.

4. A method as claimed in claim 1 or claim 3, in which said nonionic surface active agent is added in an amount of 0.01 to 1.0% by weight, based the weight of said mixture.

5. A method as claimed in claim 4, in which said mixture consists essentially of 20 to 70% by weight of coal and 80 to 30% by weight of fuel oil.

6. A method as claimed in claim 1, which comprises the steps of first adding the coal to the fuel oil, then mixing and pulverizing the mixture, then adding said agent to the mixture and further mixing the resulting mixture.

7. A stabilized mixture of finely divided coal and fuel oil prepared by the method of claim 1.

* * * * *